US007579785B2

(12) United States Patent
Shinmen et al.

(10) Patent No.: US 7,579,785 B2
(45) Date of Patent: Aug. 25, 2009

(54) MULTIPLE-LIGHT DISCHARGE LAMP LIGHTING DEVICE

(75) Inventors: Hiroshi Shinmen, Kitasaku-gun (JP); Robert Weger, Wels (AT)

(73) Assignee: Minebea Co., Ltd., Kitasaku-gun (JP)

( * ) Notice: Subject to any disclaimer, the term of this patent is extended or adjusted under 35 U.S.C. 154(b) by 245 days.

(21) Appl. No.: 11/794,115

(22) PCT Filed: Dec. 16, 2005

(86) PCT No.: PCT/JP2005/023160

§ 371 (c)(1),
(2), (4) Date: Aug. 13, 2007

(87) PCT Pub. No.: WO2006/068055

PCT Pub. Date: Apr. 29, 2006

(65) Prior Publication Data

US 2008/0211423 A1 Sep. 4, 2008

(30) Foreign Application Priority Data

Dec. 24, 2004 (JP) ..... 2004-374098

(51) Int. Cl.
*H05B 41/16* (2006.01)
*H05B 41/24* (2006.01)
*H05B 37/00* (2006.01)

(52) U.S. Cl. ..... 315/259; 315/256; 315/277

(58) Field of Classification Search ..... 315/273, 315/275, 277, 291, 282

See application file for complete search history.

(56) References Cited

U.S. PATENT DOCUMENTS

| | | | | | |
|---|---|---|---|---|---|
| 4,353,009 | A * | 10/1982 | Knoll | 315/220 |
| 4,441,054 | A * | 4/1984 | Bay | 315/219 |
| 5,055,747 | A * | 10/1991 | Johns | 315/307 |
| 6,310,444 | B1 | 10/2001 | Chang | |
| 7,215,087 | B2 * | 5/2007 | Matsushima | 315/274 |
| 7,235,931 | B2 * | 6/2007 | Matsushima et al. | 315/240 |
| 7,239,091 | B2 * | 7/2007 | Shinmen et al. | 315/224 |
| 7,541,747 | B2 * | 6/2009 | Shinmen et al. | 315/255 |
| 2005/0184684 | A1 | 8/2005 | Matsushima et al. | |

FOREIGN PATENT DOCUMENTS

| | | |
|---|---|---|
| JP | U 02-108297 | 8/1990 |
| JP | A 06-068981 | 3/1994 |

(Continued)

*Primary Examiner*—Douglas W Owens
*Assistant Examiner*—Minh D A
(74) *Attorney, Agent, or Firm*—Oliff & Berridge, PLC

(57) ABSTRACT

To provide a multiple-light discharge lamp lighting device that stabilizes and equalizes tube current of a plurality of discharge lamps without arranging a Ballast element to the secondary side of an inverter transformer with low costs. A multiple-light discharge lamp lighting device 10 according to the present invention includes inverter means 12 and a plurality of inverter transformers $TR_1$ to $TR_n$. Discharge lamps $La_1$ to $La_n$ are connected to secondary windings Ns1 to Nsn of the inverter transformers $TR_1$ to $TR_n$. Preferably, variable impedance elements $Z_1$ to $Z_n$, as variable inductance elements, are serially connected to primary windings Np1 to Npn of the plurality of inverter transformers $TR_1$ to $TR_n$. Accordingly, the tube current can be stabilized and equalized without using an element resistant to a high voltage.

2 Claims, 4 Drawing Sheets

FOREIGN PATENT DOCUMENTS

| | | | |
|---|---|---|---|
| JP | A 07-045393 | | 2/1995 |
| JP | A 09-298093 | | 11/1997 |
| JP | A 11-260580 | | 9/1999 |
| JP | B2 3256992 | | 12/2001 |
| JP | A 2002-175891 | | 6/2002 |
| JP | A 2003-045686 | | 2/2003 |
| JP | 2004-506294 | | 2/2004 |
| JP | 1 566 991 | A1 | 8/2005 |
| JP | 2005-235616 | | 9/2005 |
| WO | WO 02/13581 | A2 | 2/2002 |

* cited by examiner

MULTIPLE-LIGHT DISCHARGE LAMP LIGHTING DEVICE

TECHNICAL FIELD

The present invention relates to a multiple-light discharge lamp lighting device that lights-on a plurality of discharge lamps. More particularly, the present invention relates to a multiple-light discharge lamp lighting device that lights-on a cathode ray tube used as a light source for multiple-light backlight of a liquid crystal display device.

BACKGROUND ART

As a light source for backlight of a liquid crystal display device, e.g., a discharge lamp such as cathode ray tube is widely used. In general, this discharge lamp is lit-on with AC by a discharge lamp lighting device having an inverter. In recent years, corresponding to high luminance and large scale of the liquid crystal display device, as an illumination light source of this liquid crystal display device, a multiple-light backlight using a plurality of discharge lamps is frequently used.

Since the light-on operation of the discharge lamp generally requires a high voltage, the discharge lamp lighting device normally has an inverter transformer that generates a high voltage on the secondary side, inverter means that generates a high-frequency voltage is connected to the primary side of the inverter transformer and a discharge lamp and a so-called Ballast element for stabilizing tube current of the discharge lamp having a negative-resistance characteristic, e.g., a Ballast condenser are connected to the secondary side. Conventionally, even upon lighting-on a plurality of discharge lamps, the Ballast condensers are connected to the individual discharge lamps, thereby realizing a multiple-light discharge lamp lighting device (refer to, e.g., Patent Document 1).

Further, upon lighting-on a plurality of discharge lamps, tube current of the individual discharge lamps needs to be equalized so as to make the luminance of the discharge lamps uniform. In the discharge lamp lighting device having a plurality of discharge lamps to which the Ballast condensers are connected, variation in characteristics of the Ballast condensers can cause variation in tube current. Therefore, such one circuit structure is proposed that the tube current of the discharge lamps is equalized by arranging a balance coil on the secondary side of the inverter transformer (refer to, e.g., Patent Document 2). Further, such another circuit structure is proposed that a constant current source with a low voltage is arranged to the primary side of the inverter transformer and the Ballast condenser is not required by supplying current from the constant current source with the low voltage (refer to, e.g., Patent Document 3), and the use of a multiple-light discharge lamp lighting device with the other circuit structure can advantageously equalize the tube current.

Patent Document 1: Japanese Unexamined Patent Application Publication No. 2002-175891

Patent Document 2: Japanese Unexamined Patent Application Publication No. 7-45393

Patent Document 3: Specification of Japanese Patent No. 3256992

DISCLOSURE OF INVENTION

Problems to be Solved by the Invention

However, with the discharge lamp lighting device disclosed in Patent Document 1, in addition to the above-mentioned variation in tube current, an output voltage including the decrease in voltage of the Ballast condenser serially-connected to the discharge lamp needs to be generated on the secondary side so as to obtain a tube voltage required for lighting-on the discharge lamp, and there is a problem that the increase in shape of the inverter transformer results in preventing the size reduction of the device. Further, with the discharge lamp lighting device disclosed in Patent Document 2, the balance coil arranged to the secondary side requires large inductance and there is a problem that a large-scaled element is required as the balance coil, costs increase, and this results in preventing the size reduction of the device.

Further, upon lighting-on the discharge lamp lighting device disclosed in Patent Document 3, the above-mentioned problems can be prevented and this circuit structure however has the following problem. That is, as a light source of the discharge lamp lighting device used as the backlight of the liquid crystal display, a constant-voltage light source common to the liquid crystal drive circuit is generally used. Therefore, the use of the constant current source to the discharge lamp lighting device means the addition of another element to the liquid crystal display device, and costs of the entire device increase.

In consideration of the problems, it is an object of the present invention to provide a multiple-light discharge lamp lighting device that stabilizes and equalizes tube current of a plurality of discharge lamps without arranging a Ballast element to the secondary side of an inverter transformer with low costs.

Means for Solving the Problems

In order to accomplish the object, according to the present invention, there is provided a multiple-light discharge lamp lighting device comprising inverter means that outputs a high-frequency voltage and a plurality of inverter transformers, the multiple-light discharge lamp lighting device lighting-on a plurality of discharge lamps connected to secondary windings of the plurality of inverter transformers, in which a variable inductance element as a ballast element is connected in series to each of primary windings of the plurality of the inverter transformers; and the variable inductance element is provided with a main winding and a control winding in such a manner that the main winding is connected to the primary winding of the inverter transformer, and the control winding has current signal input that corresponds to fluctuation of tube current flowing in the discharge lamps for variably controlling inductance value of the variable inductance element so as to stabilize the tube current flowing in the discharge lamps.

Further, a condenser is connected in parallel to each of the primary windings of the plurality of the inverter transformers.

Advantages

With the multiple-light discharge lamp lighting device according to the present invention, the variable inductance elements are serially connected to the primary windings of a plurality of inverter transformers and the variable inductance elements consequently function as the Ballast elements. Therefore, the discharge lamp lighting device that stabilizes the tube current without connecting the Ballast elements to the secondary sides can be realized without increasing the number of parts in the conventional structure. Further, the inductance of the variable inductance elements is individually controlled in accordance with the tube current of the discharge lamps. Accordingly, the tube current of the discharge lamps can be equalized or can be set to a desired value.

Furthermore, according to the present invention, since the variable inductance element is connected not to the secondary side of the inverter transformer to which a high voltage is applied, but to the primary side, an element resistant to a high voltage may not be used, costs of parts reduce, a danger of a failure and ignition due to breakdown of the element is solved, and the safety of the device is improved. In addition, since the Ballast element may not be serially connected to the discharge lamp on the secondary side of the inverter transformer, output power of the inverter transformer can be suppressed to be low. Moreover, even if causing the short-circuit (so-called layer short) between the windings on the secondary side of the inverter transformer, the variable impedance element on the primary side can suppress overcurrent flowing to the winding, and smoking and ignition of the inverter transformer can be prevented.

Further, the inductance of the variable inductance element can be minified compared to the case that the inductance is connected to the secondary side of the inverter transformer. Therefore, the variable impedance element can be reduced in size. Further, the inductance on the primary side suppresses a high-harmonic component of a high order. As a consequence, noises can be removed from an input waveform applied to the inverter transformer and heat generation of the transformer caused by the high-harmonic component is suppressed. Thus, the heat generation of the transformer is entirely reduced.

REFERENCE NUMERALS

10, 30: discharge lamp lighting device
12: inverter means
13: switching means (full-bridge circuit)
$Z_1$ to $Z_n$: variable impedance element
$L_1$, $L_2$: variable inductance element
$TR_1$ to $TR_n$: inverter transformer
$La_1$ to $La_n$: discharge lamp

BEST MODE FOR CARRYING OUT THE INVENTION

Figure 1:
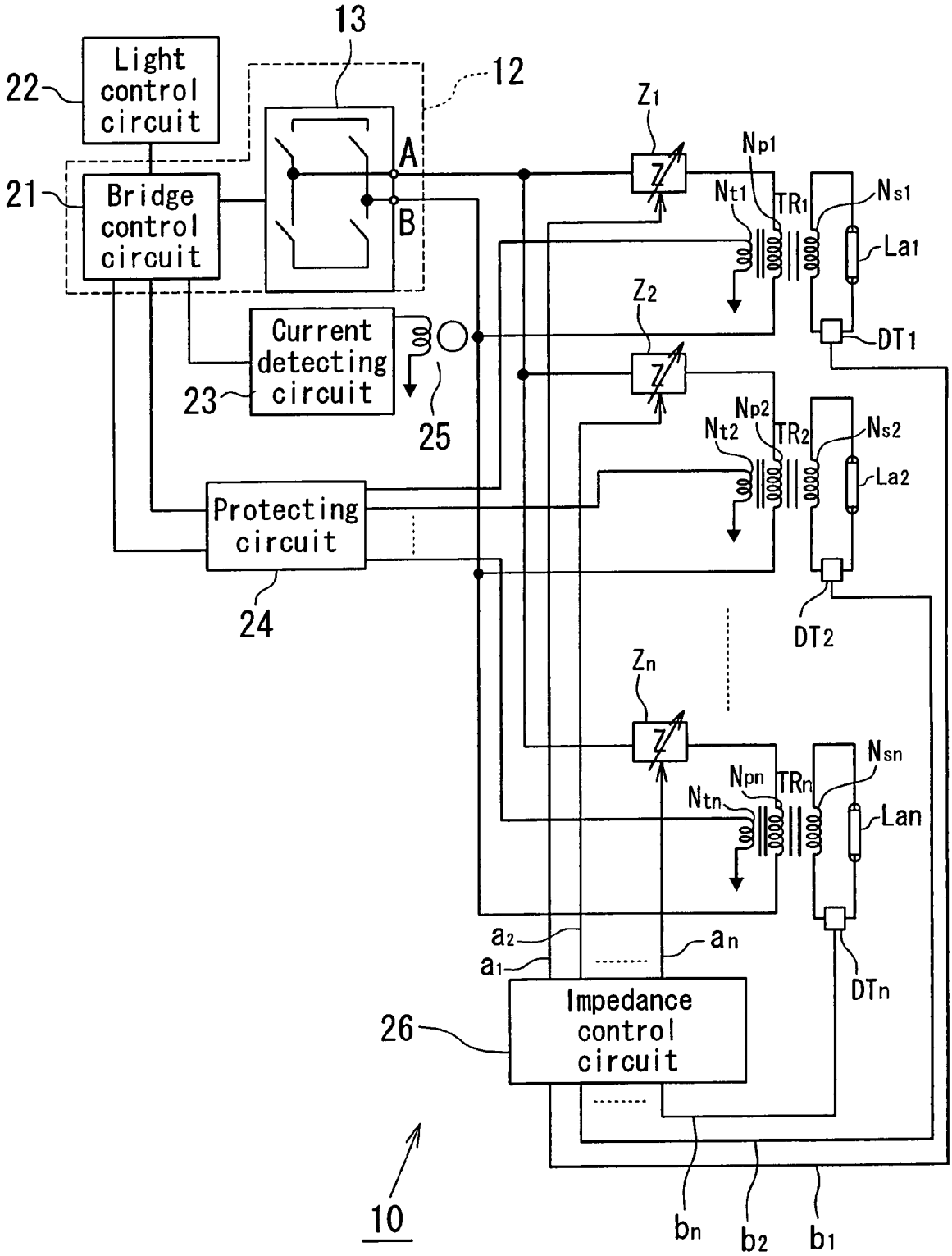
FIG. 1 is a diagram generally showing a circuit structure of a discharge lamp lighting device according to the first embodiment of the present invention.

Hereinbelow, a detailed description will be given of a multiple-light discharge lamp lighting device according to embodiments of the present invention with reference to the drawings. FIG. 1 is a diagram showing a circuit structure of a discharge lamp lighting device 10 that controls lighting operation of a plurality of (assumed as n) discharge lamps according to the first embodiment of the present invention, and variable inductance elements according to the present invention are designated as variable impedance elements $Z_1$ to $Z_n$ for generally explaining the framework of the embodiments of the present invention. The discharge lamp lighting device 10 comprises inverter means 12 and n inverter transformers $TR_1$ to $TR_n$, and discharge lamps $La_1$ to $La_n$ such as cathode ray tubes are directly connected to secondary windings Ns1 to Nsn of the inverter transformers $TR_1$ to $TR_n$, not via Ballast elements. Further, variable impedance element $Z_1$ to $Z_n$ are serially connected to first ends of Np1 to Npn of the inverter transformers $TR_1$ to $TR_n$, and are connected in parallel to the inverter means 12. Moreover, the discharge lamp lighting device 10 according to the first embodiment comprises an impedance control circuit 26, and output signals $b_1$ to $b_n$ from tube current detecting circuits $DT_1$ to $DT_n$ arranged to wirings of the secondary sides of the inverter transformers $TR_1$ to $TR_n$ are connected to the impedance control circuit 26, and control signals $a_1$ to $a_n$ from the impedance control circuit 26 are connected to the variable impedance elements $Z_1$ to $Z_n$.

Figure 2:
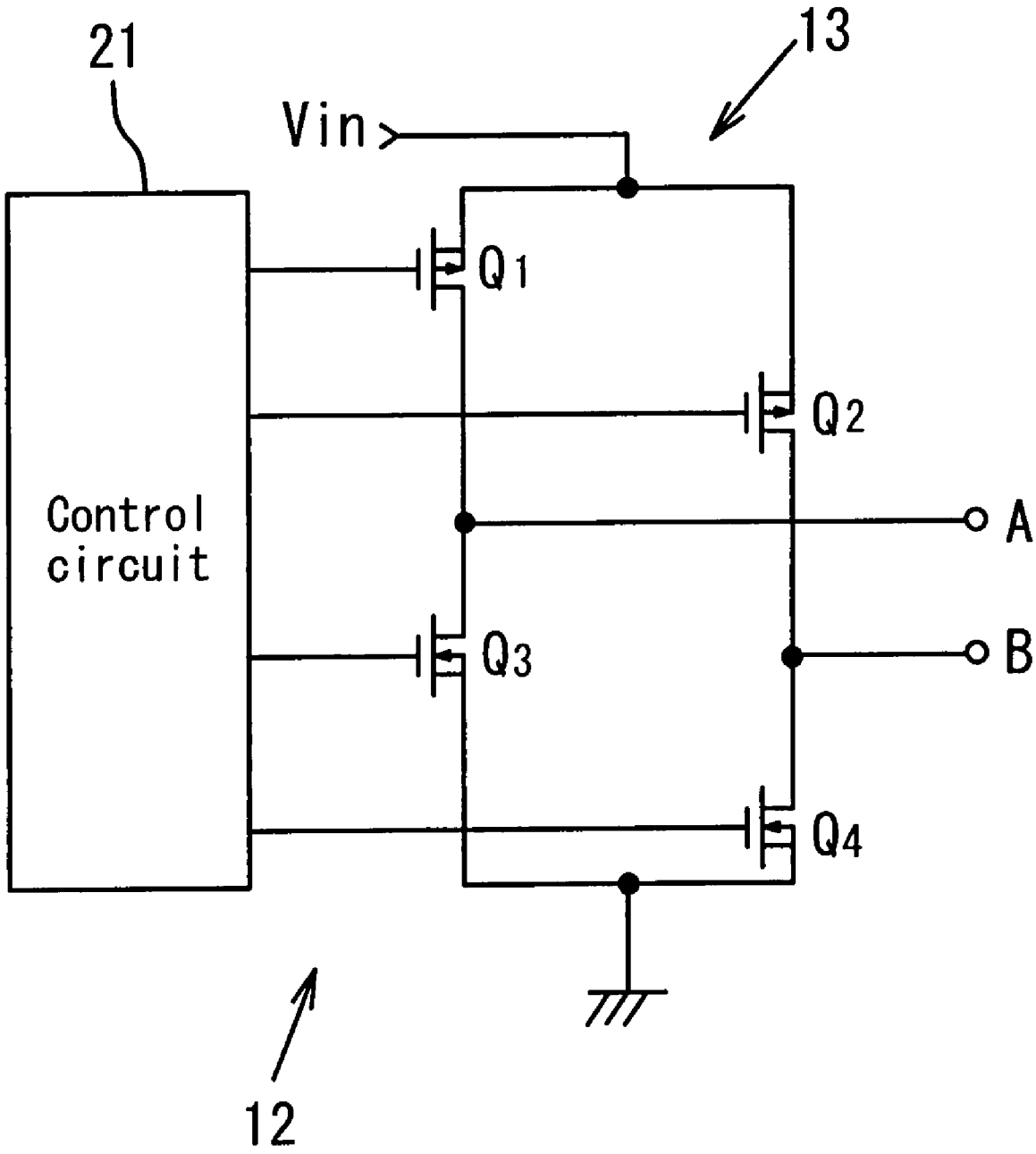
FIG. 2 is a diagram showing a circuit structure of inverter means in the discharge lamp lighting device shown in FIG. 1.

The inverter means 12 comprises a full-bridge circuit serving as switching means 13 and a bridge control circuit 21 that drives the full-bridge circuit 13. As shown in FIG. 2, the full-bridge circuit 13 is structured by connecting in parallel a pair of switching elements Q1 and Q3 serially-connected and a pair of switching elements Q2 and Q4 serially-connected as mentioned above. For example, the switching elements Q1 and Q2 comprise PMOSFETs, and the switching elements Q3 and Q4 comprise NMOSFETs. The inverter means 12 alternately repeats on/off operation of the pairs (Q1, Q4) and (Q2, Q3) of the switching elements by a predetermined frequency (e.g., approximately 60 kHz) in accordance with a gate voltage output from the bridge control circuit 21 so as to convert a DC voltage Vin into a high-frequency voltage, and outputs the converted voltage to output terminals A and B.

The discharge lamp lighting device 10 comprises a light control circuit 22, a current detecting circuit 23, and a protecting circuit 24 in addition to the above-mentioned components. The discharge lamp lighting device according to the present invention is not limited to the presence or absence of the circuits 22 to 24. Functions of the circuits 22 to 24 will be briefly described as follows. First, the current detecting circuit 23 generates a proper signal in accordance with a current value detected by a current transformer 25, and outputs the generated signal to the bridge control circuit 21. As a consequence, the bridge control circuit 21 changes on-duty of the switching elements Q1 to Q4 included in the inverter means 12, and adjusts power turned-on to the inverter transformers $TR_1$ to $TR_n$. The protecting circuit 24 generates a proper signal in accordance with a voltage detected by tertiary windings Nt1 to Ntn of the inverter transformers $TR_1$ to $TR_n$, and outputs the generated signal to the bridge control circuit 21. As a consequence, upon detecting an abnormal state of the discharge lamps $La_1$ to $La_n$ such as an open state or short circuit thereof, the bridge control circuit 21 stops the operation of the inverter means 12 and protects the device. Further, the light control circuit 22 outputs a signal for adjusting the luminance of the discharge lamp La by burst light-control to the bridge control circuit 21. Thus, the bridge control circuit 21 intermittently operates the inverter means 12 by a frequency of 150 to 300 Hz, thereby adjusting average luminance of the discharge lamps $La_1$ to $La_n$. In the example shown in the drawing, the bridge control circuit 21 adjusts the power by a signal from the current detecting circuit 23 and however may adjust the power by inputting the signals $b_1$ to $b_n$ from the tube current detecting circuits $DT_1$ to $DT_n$ to the bridge control circuit 21.

In the discharge lamp lighting device 10, the variable impedance elements $Z_1$ to $Z_n$ function as Ballast impedance elements and realize the stabilization of tube current of the discharge lamps $La_1$ to $La_n$.

For example, upon increasing the tube current (hereinafter, also referred to as current on the secondary side) of the discharge lamp $La_1$ for some reasons, current (hereinafter, also referred to as current on the primary side) flowing to the primary winding Np1. However, a voltage applied by the inverter means 12 is constant and impedance of the variable impedance element $Z_1$ at the time functions to reduce a drop voltage by reducing the current on the primary side, thereby suppressing the increase in tube current on the primary side.

Similarly, the tube current of the discharge lamp $La_1$ decreases and the current on the primary side also drops. In this case, the impedance of the variable impedance element $Z_1$ at the time functions to raise a drop voltage by increasing the current on the primary side, thereby suppressing the reduction in tube current on the secondary side. As mentioned above, the variable impedance elements $Z_1$ to $Z_n$ realize the stabilization of the discharge lamps $La_1$ to $La_n$.

Further, in the discharge lamp lighting device 10, the variable impedance elements $Z_1$ to $Z_n$ are connected to the primary windings of the inverter transformers $TR_1$ to $TR_n$. Therefore, by assuming a winding ratio (the number of secondary windings/the number of primary windings) of the inverter transformer $TR_1$ as N and equivalent load resistance of the discharge lamp $La_1$ as R, the impedance necessary for the Ballast impedance element then has a proper value with respect to equivalent load resistance $R/N^2$ in view of the primary side of the inverter transformer $TR_1$.

Moreover, in the discharge lamp lighting device 10, the impedance control circuit 26 varies and controls impedance values of the variable impedance elements $Z_1$ to $Z_n$, and sets, to predetermined values, the levels of the tube current of the discharge lamps $La_1$ to $La_n$ that are kept stable by the function of the Ballast impedance elements. The impedance control circuit 26 determines the control signals $a_1$ to $a_n$ by the output signals $b_1$ to $b_n$ output from the tube current detecting circuit $DT_1$ to $DT_n$ in accordance with the tube current of the discharge lamps $La_1$ to $La_n$, and individually varies and controls the impedance of the variable impedance elements $Z_1$ to $Z_n$ by the control signals $a_1$ to $a_n$.

For example, when the output signal $b_1$ of the tube current detecting circuit $DT_1$ indicates that a value of the tube current of the discharge lamp $La_1$ is larger than a predetermined value, the impedance control circuit 26 sends a signal for increasing the impedance of the variable impedance element $Z_1$ as the control signal $a_1$. As a consequence thereof, the current on the primary side of the inverter transformer $TR_1$ reduces and the current on the secondary side, i.e., the tube current of the discharge lamp $La_1$ thus reduces. On the contrary, when the output signal $b_1$ of the tube current detecting circuit $DT_1$ indicates that a value of the tube current of the discharge lamp $La_1$ is smaller than a predetermined value, the impedance control circuit 26 sends a signal for decreasing the impedance of the variable impedance element $Z_1$ as the control signal $a_1$. As a consequence thereof, the current on the primary side of the inverter transformer $TR_1$ increases and the current on the secondary side, i.e., the tube current of the discharge lamp $La_1$ thus increases.

As mentioned above, by setting the levels of the tube current of the discharge lamps $La_1$ to $La_n$ individually-controlled to be identical, the tube current can be equalized. Alternatively, in consideration of a factor influencing to the luminance of the discharge lamp, such as a temperature distribution of the backlight device, the current of the discharge lamps $La_1$ to $La_n$ can also be set to be desired values.

Further, the connection of the Ballast impedance elements to the primary sides of the inverter transformers $TR_1$ to $TR_n$ has the following advantages, in the operation upon causing the short circuit (so-called layer short) between the windings on the secondary side.

In the conventional discharge lamp lighting device, upon causing the layer short at the secondary winding of any of the inverter transformers, the circuit on the secondary side enters a state in which resistance r at the short-circuit part of the secondary winding is connected to the secondary side, irrespective of the impedance of the discharge lamp and the Ballast element. Therefore, there is such a danger that overcurrent flows to the inverter transformer, thereby resulting in smoking and ignition. At the time, a voltage of the inverter transformer on the primary side is designated by Vp and load resistance in the case of the layer short in view of the primary side is designated by rp. Then, the power loss at the short-circuit part is expressed as follows.

$$P=Vp^2/rp$$

However, in the discharge lamp lighting device 10 according to the first embodiment, upon causing the layer short at the secondary winding Ns1 of the inverter transformer $TR_1$, loss P at the short-circuit part is as follows.

$$P=rp\cdot Vp^2/(|Z_1|^2+rp^2)$$

Obviously, impedance (similarly expressed by Z) of the variable impedance element $Z_1$ suppresses the power loss, i.e., heat generation due to the overcurrent.

As such a variable impedance element according to the present invention, it is possible to use the resistor, condenser, inductor, or any type of the variable impedance element obtained by combining these. Preferably, a variable inductance element may be used. With the discharge lamp lighting device according to the present invention, the variable impedance element connected to the primary side of the inverter transformer is used as the Ballast element. As a consequence, an element resistant to a high voltage may not be used and the inductor with power loss smaller than the resistor can thus be advantageously used as the Ballast element while solving the conventional drawback to increase the shape of the inductor resistant to a high voltage. As mentioned above, in addition, the load resistance of the inverter transformer in view of the primary side is reduced to $1/N^2$. Therefore, in the discharge lamp lighting device 10, the inductance can be reduced to $L/N^2$ as compared with the case of connecting the inductor having the equivalent operation as the Ballast element to the secondary side, and the element can be further decreased in size. For example, in the discharge lamp lighting device 10, by setting a winding ratio N of the inverter transformers $TR_1$ to $TR_n$ as 100 and by using variable inductance elements, as the variable impedance elements $Z_1$ to $Z_n$, having an inductance variable range of approximately 30 μH, this can exhibit the identical function to that in the case of connecting the inductor having the inductance of approximately 300 mH, as the Ballast element, to the secondary side.

Figure 3:
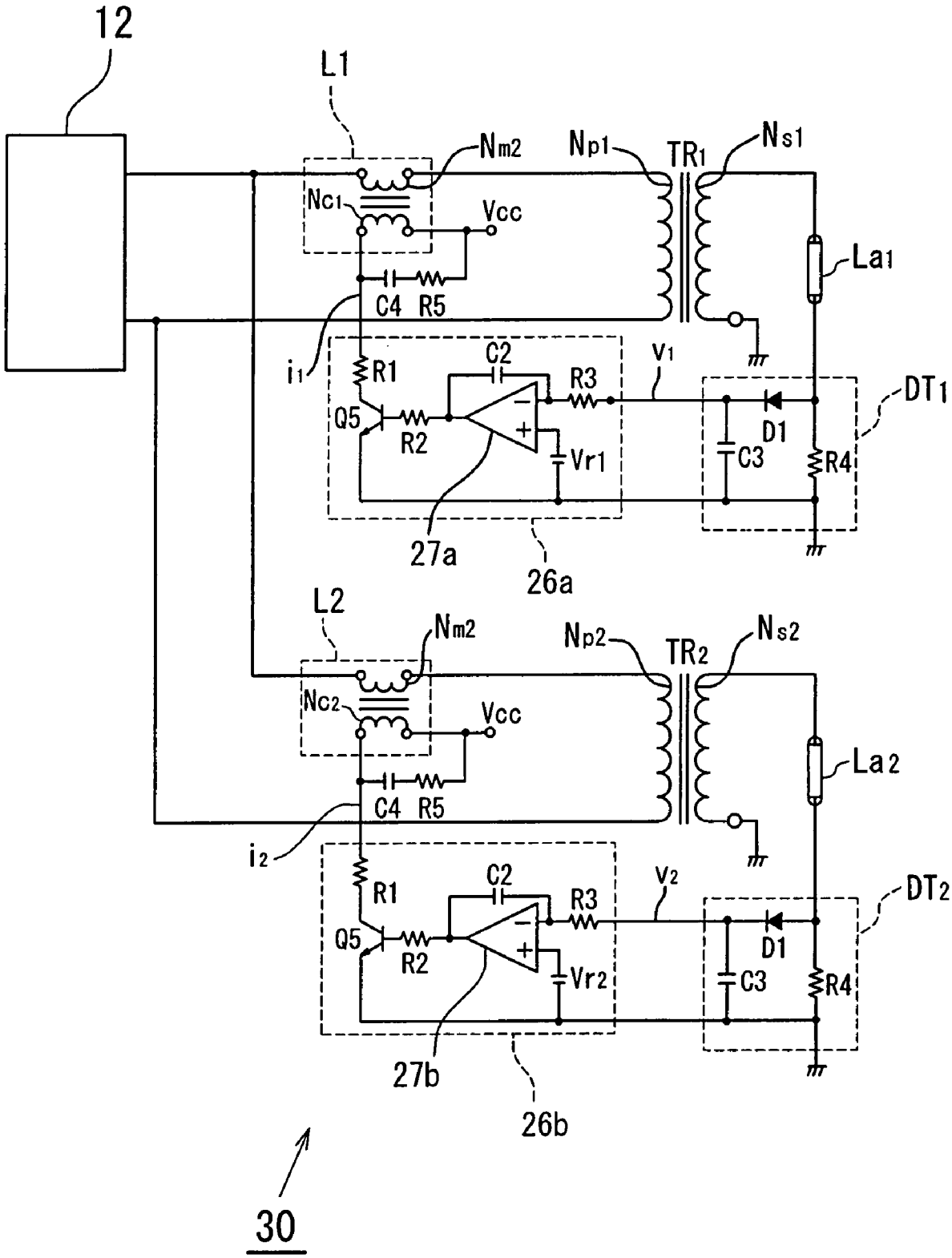
FIG. 3 is a diagram showing in detail a circuit structure of a discharge lamp lighting device according to the second embodiment of the present invention.

FIG. 3 is a diagram showing a circuit structure of a discharge lamp lighting device 30 according to the second embodiment of the present invention. It is noted that the discharge lamp lighting device 30 shown in FIG. 3 lights-on two discharge lamps $La_1$ and $La_2$ as one example according to the second embodiment. However, the similar structure can be applied to the case of lighting-on a plurality of, i.e., an arbitrary number of discharge lamps. Further, in the discharge lamp lighting device 30, the same components as those of the discharge lamp lighting device 10 according to the first embodiment discussed hereinabove are designated by the same reference numerals and the drawing and description thereof are omitted.

The discharge lamp lighting device 30 comprises the inverter means 12 and two inverter transformers $TR_1$ and $TR_2$, and the discharge lamps $La_1$ and $La_2$ are directly connected to the secondary windings Ns1 and Ns2 of the inverter transformers $TR_1$ and $TR_2$, not via the Ballast element. Further, variable inductance elements L1 and L2, serving as variable impedance elements according to the second embodiment, are serially connected to first ends of primary windings Np1 and Np2 of the inverter transformers $TR_1$ and $TR_2$, in parallel with the inverter means 12. The discharge lamp lighting device 30 according to the second embodiment comprises impedance control circuits 26*a* and 26*b*, and voltage signals $v_1$ and $v_2$, serving as outputs from the tube current detecting circuits $DT_1$ and $DT_2$ arranged to the wirings on the secondary sides of the inverter transformers $TR_1$ and $TR_2$, are connected to the impedance control circuits 26*a* and 26*b*. Current signals $i_1$ and $i_2$, serving as control signals from the impedance control circuit 26*a* and 26*b*, are connected to the variable inductance elements L1 and L2.

The variable inductance elements L1 and L2 according to the second embodiment comprise main windings Nm1 and Nm2 and control windings Nc1 and Nc2. The increase/decrease in DC current flowing to the control windings Nc1 and Nc2 varies and controls the inductance of the main windings Nm1 and Nm2. Specifically speaking, the DC current flowing to the control windings Nc1 and Nc2 increases, thereby reducing the inductance of the main windings Nm1 and Nm2. Further, the DC current flowing to the control windings Nc1 and Nc2 reduces, thereby increasing the inductance of the main windings Nm1 and Nm2. The main windings Nm1 and Nm2 of the variable inductance elements L1 and L2 are serially connected to the primary windings Np1 and Np2 of the inverter transformers $TR_1$ and $TR_2$, and first ends of the control windings Nc1 and Nc2 thereof are connected to a DC voltage Vcc and second ends thereof are individually connected to the impedance control circuits 26*a* and 26*b*. As a consequence, the variable inductance elements L1 and L2 function as variable impedance elements according to the second embodiment. It is noted that a snubber circuit for serially connecting a condenser C4 and a resistor R5 is connected to both ends of the control windings Nc1 and Nc2 of the variable inductance elements L1 and L2 so as to prevent a high spike voltage upon generating back electromotive force.

Next, a description will be given of the structure and operation thereof with the circuit structure including the discharge lamp $La_1$. A circuit structure including the discharge lamp $La_2$ has the same structure and operation.

The tube current detecting circuit $DT_1$ connected to the discharge lamp $La_1$ comprises a resistor R4 for detecting the tube current, a rectifying diode D1, and a smoothing condenser C3, and tube current flowing to the discharge lamp $La_1$ is further converted into a voltage by the resistor R4 for detecting the tube current, is rectified by the rectifying diode D1, and is smoothed by the smoothing condenser C3. Thereafter, the resultant signal is output, as the voltage $v_1$, to the impedance control circuit 26*a*. The voltage signal $v_1$ is input to an inverting input terminal of an operational amplifier 27*a* included in the impedance control circuit 26*a*.

A reference voltage Vr1 is input to a non-inverting input terminal of the operational amplifier 27*a*, the voltage signal $v_1$ is compared with the reference voltage Vr1, and the output is added to a base of a transistor Q5. A collector of the transistor Q5 is connected to the control winding Nc1 of the variable inductance element L1, and collector current of the transistor Q5, which increases/decreases in accordance with an output voltage of the operational amplifier 27*a*, is output, as the current signal $i_1$, from the impedance control circuit 26*a*. The inductance of the main winding Nm1 in the variable inductance element L1 is varied and controlled by the current signal $i_1$, i.e., current flowing to the control winding Nc1.

That is, when the tube current flowing to the discharge lamp $La_1$ is smaller than a predetermined value, the voltage of the resistor R4 for detecting the tube current drops. Therefore, an output voltage of the operational amplifier 27*a* rises, base current of the transistor Q5 increases, and collector current thereof thus increases. Accordingly, the increase in current flowing to the control winding Nc1 of the variable inductance element L1 causes the decrease in inductance of the main winding Nm1. On the other hand, when the tube current flowing to the discharge lamp $La_1$ is larger than a predetermined value, the voltage of the resistor R4 for detecting the tube current rises, the output voltage of the operational amplifier 27*a* drops, the base current of the transistor Q5 reduces, and collector current also drops. Therefore, the decrease in current flowing to the control winding Nc1 of the variable inductance element L1 results in the increase in inductance of the main winding Nm1. As mentioned above, with the discharge lamp lighting device 30 according to the second embodiment, the variable inductance element L1 functions as a variable impedance element according to the present invention, thereby obtaining the above-mentioned operation and advantage with the discharge lamp lighting device 10 according to the first embodiment. Further, the level of tube current of the discharge lamp $La_1$, which is maintained as mentioned above, can be set to a predetermined value by adjusting the value of the reference voltage Vr1 input to the non-inverting input terminal of the operational amplifier 27*a*.

Moreover, according to the second embodiment, the variable inductance elements L1 and L2 function as low-pass filters and cut-off a harmonic component of the output voltage of the inverter means 12, thereby setting a voltage waveform applied to the winding Np on the primary side to be substantially sine-wave shaped. As a consequence, noises are removed from the inverter transformers $TR_1$ and $TR_2$, and the heat generation of the inverter transformers $TR_1$ and $TR_2$ caused by the harmonic component is suppressed.

According to the first and second embodiments hereinabove discussed, the inverter means 12 comprises a separate-excitation circuit with high efficiency, comprising the full-bridge circuit 13 and the control circuit 21. The full-bridge circuit 13 is driven by the control circuit 21 at a predetermined frequency. Therefore, unlike a Royer circuit in which a drive frequency of the inverter means is determined by a resonant frequency of an LC resonant circuit arranged to the primary side of the inverter transformer, an element having arbitrary proper impedance, as a Ballast one, can be connected to the primary side without considering the influence to the resonant frequency, and the impedance can be varied and controlled.

Incidentally, according to the first and second embodiments hereinabove discussed, the tube current detecting circuits $DT_1$ to $DT_n$ can comprise current transformers. Further, in place of the tube current detecting circuits $DT_1$ to $DT_n$, the luminances of the discharge lamps $La_1$ to $La_n$ are measured with an optical sensor, and signals corresponding to the luminances may be outputted to the impedance control circuits 26, 26*a*, and 26*b*.

The multiple-light discharge lamp device according to the present invention is not limited to the discharge lamp lighting devices 10 and 30. The following components can be added to the multiple-light discharge lamp lighting devices 10 and 30.

Figure 4:
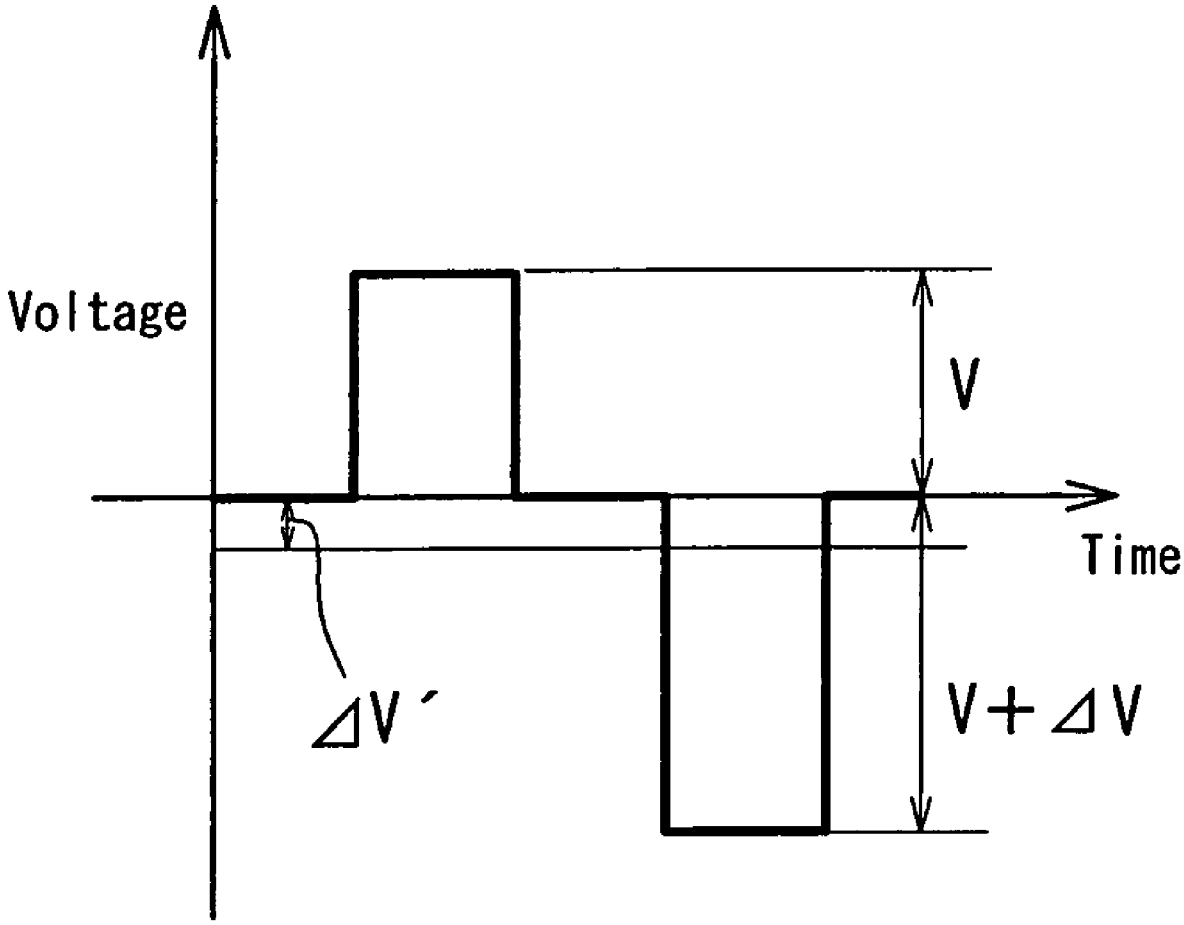
FIG. 4 is a graph schematically showing an asymmetrical voltage waveform of inverter means.

For example, in the discharge lamp lighting devices 10 and 30, condensers may be serially connected between the inverter means 12 and the primary windings of Np1 to Npn of the inverter transformers $TR_1$ to $TR_n$. As shown in FIG. 4, when the output waveform of the inverter means 12 includes an asymmetrical waveform of a voltage V in one direction and a voltage V+ΔV in another direction, a DC voltage of ΔV' (where ΔV' is an average of ΔV based on time) is averagely superimposed to the output voltage. Therefore, if the Ballast impedance element includes only an inductor, high DC current is superimposed to the inverter transformers $TR_1$ to $TR_n$, and this causes magnetic saturation and deterioration in efficiency. In this case, the condenser serially-connected to the inverter means 12 is added to the Ballast impedance element. As a consequence, it is possible to cut-off a DC component of the asymmetric voltage waveform and to improve the symmetricity of a voltage applied to the primary winding of the inverter transformer TR.

Further, in the discharge lamp lighting devices 10 and 30, the condensers may be connected in parallel to the primary windings Np1 to Npn of the inverter transformers $TR_1$ to $TR_n$ so as to stabilize the tube current by adjusting a resonant frequency of a resonant circuit on the secondary side and to set voltage waveforms applied to the primary windings Np1 to Npn of the inverter transformers $TR_1$ to $TR_n$ to be substantially sine-wave shaped by more efficiently cut-off the harmonic component of the output voltage of the inverter means 12.

The invention claimed is:

1. A multiple-light discharge lamp lighting device comprising inverter means that outputs a high-frequency voltage and a plurality of inverter transformers, the multiple-light discharge lamp lighting device lighting-on a plurality of discharge lamps connected to secondary windings of the plurality of inverter transformers, wherein a variable inductance element as a ballast element is connected in series to each of primary windings of the plurality of the inverter transformers; and the variable inductance element is provided with a main winding and a control winding in such a manner that the main winding is connected to the primary winding of the inverter transformer, and the control winding has current signal input that corresponds to fluctuation of tube current flowing in the discharge lamps for variably controlling inductance value of the variable inductance element so as to stabilize the tube current flowing in the discharge lamps.

2. The multiple-light discharge lamp lighting device according to claim 1, wherein a condenser is connected in parallel to each of the primary windings of the plurality of the inverter transformers.

* * * * *